United States Patent [19]

Crouse et al.

[11] Patent Number: 4,973,384

[45] Date of Patent: Nov. 27, 1990

[54] HEATED EXTENDED NIP PRESS APPARATUS

[75] Inventors: Jere W. Crouse; Jeffrey H. Pulkowski; Roy J. Porter, all of Beloit, Wis.

[73] Assignee: Beloit Corporation, Beloit, Wis.

[21] Appl. No.: 370,933

[22] Filed: Jun. 23, 1989

[51] Int. Cl.[5] ..... D21F 3/00

[52] U.S. Cl. ..... 162/359; 162/358; 100/93 RP

[58] Field of Search ..... 162/205, 206, 358, 359, 162/375; 100/93 RP, 38; 34/111, 116, 123

[56] References Cited

U.S. PATENT DOCUMENTS

| | | | |
|---|---|---|---|
| 4,287,021 | 9/1981 | Justus et al. | 162/358 |
| 4,568,423 | 2/1986 | Laapotti | 162/358 |
| 4,570,314 | 2/1986 | Holik | 29/113.1 |
| 4,576,682 | 3/1986 | Laapotti | 162/358 |
| 4,713,147 | 12/1987 | Saarinen | 162/358 |
| 4,738,752 | 4/1988 | Busker et al. | 162/358 |

FOREIGN PATENT DOCUMENTS

| | | | |
|---|---|---|---|
| 2199398 | 7/1988 | United Kingdom | 162/358 |

*Primary Examiner*—Karen M. Hastings

*Attorney, Agent, or Firm*—Dirk J. Veneman; Raymond W. Campbell; David J. Archer

[57] ABSTRACT

A heated extended nip press apparatus is disclosed for pressing water from a formed web. The apparatus includes a frame and a backing roll rotatably supported by the press frame. A press device is connected to the press frame and movable relative to the backing roll. The press device cooperates with the backing roll for defining therebetween an extended nip for the passage therethrough of the web. An endless looped blanket extends through the extended nip such that the web is disposed between the blanket and the backing roll. Additionally, the press device includes an arrangement for selectively changing the pressure applied on the blanket along a machine direction relative to a further pressure applied for moving the press device relative to the backing roll such that optimum web properties are obtained and delamination of the pressed web is inhibited. Cross-machine direction recesses in the press shoe enable the shoe to be selectively positioned in the machine direction.

3 Claims, 6 Drawing Sheets

#2 .04696 VS. 27.23 psi-sec
#3 .05095 VS. 29.55 psi-sec
#4 .04992 VS. 28.95 psi-sec

HEATED EXTENDED NIP PRESS APPARATUS

BACKGROUND OF THE INVENTION

1. Field of the Invention

The present invention relates to a heated extended nip press apparatus and a method for obtaining optimum web properties while inhibiting delamination of the pressed web.

2. Information Disclosure Statement

Extended nip press arrangements have enabled the removal of far greater quantities of water from the formed web when compared with more conventional roll presses which include at least a pair of cooperating rolls defining therebetween a press nip.

More particularly, such extended nip presses have reduced the costs involved in the subsequent drying of the pressed web in a dryer section.

An extended nip press essentially includes a backing roll and a press shoe having a concave surface which cooperates with the backing roll for defining therebetween an extended nip. An endless looped blanket moves contiguously with a felt and the formed web through the extended nip with the interface between the blanket and the shoe being lubricated. The felt acts as a carrier for the weak wet web and collects water therefrom. Accordingly, by the application of pressure for an increased period of time, the increased residence time not only enables the removal of more water from the formed web but also in certain applications improves the properties of the resultant web.

More recently, as disclosed in U.S. Pat. No. 4,738,752 to Busker et al, the extended nip press arrangement has been enhanced by the application of heat to the backing roll, such heat being applied to the backing roll typically by means of an induction heater.

Evidently, the application of induction heating reduces the viscosity of the water within the formed web thereby facilitating the removal of more water from the web. Additionally, the application of thermal energy causes the generation of steam within the extended nip, such that the steam within the web forces water in the liquid phase out of the web thereby further enhancing the water removing capabilities of the extended nip press.

However, in view of the rapid generation of steam within the extended nip, there existed a certain tendency of the web to delaminate on exiting from the extended nip. Accordingly, various temperatures were used with different residence times and pressures in an attempt to minimize such tendency to delaminate.

During the course of such experimentation, a discovery was made that by gradually decreasing the pressure in a machine direction towards the trailing edge of the shoe, rapid flashing of steam from the emerging pressed web was avoided. Rapid flashing of steam from the web was recognized as being the main cause of the delamination problem.

By selectively changing the pressure applied on the blanket along a machine direction, not only was the problem of delamination alleviated but unexpectedly the properties of the resultant pressed web were enhanced.

Therefore, it is a primary object of the present invention to provide a heated extended nip press apparatus which overcomes the aforementioned problems associated with the prior proposals and which makes a considerable contribution to the art of high temperature pressing.

Another object of the present invention is the provision of a press means which includes means for selectively changing the pressure applied on a blanket along a machine direction relative to a further pressure applied for moving the press means relative to the backing roll such that optimum web properties are obtained and delamination of the pressed web is inhibited.

Another object of the present invention is the provision of a heated extended nip press apparatus having an induction heater disposed closely adjacent to the backing roll for heating the backing roll thereby increasing the amount of water removed from the formed web during passage of the web through the extended nip.

Another object of the present invention is the provision of a heated extended nip press apparatus which includes a hydrodynamic shoe defining therein a plurality of cross-machine directional recesses. The recesses selectively cooperate with a piston so that the shoe is permitted to pivot about the piston, the shoe being selectively positioned in a machine direction relative to the piston to optimize the web properties and to inhibit delamination of the pressed web.

Another object of the present invention is the provision of a heated extended nip press apparatus in which the press means includes a rod rigidly secured to a piston and disposed between the piston and the shoe. The rod extends in a cross-machine direction such that the rod pivotally supports and is selectively disposed within one of the plurality of recesses.

Another object of the present invention is the provision of a heated extended nip press apparatus which includes a hydrostatic shoe defining a plurality of pockets disposed in a machine direction with each of the pockets being selectively connected to a source of hydraulic pressure such that the blanket is hydrostatically supported by the shoe and so that optimum web properties are obtained and delamination of the pressed web is inhibited.

Other objects and advantages of the present invention will be readily apparent to those skilled in the art by a consideration of the detailed description contained hereinafter taken in conjunction with the annexed drawings.

SUMMARY OF THE INVENTION

The present invention relates to a heated extended nip press apparatus and method for pressing water from a formed web. The apparatus includes a press frame and a backing roll rotatably supported by the press frame. A press means is connected to the press frame and movable relative to the backing roll. The press means cooperates with the backing roll for defining therebetween an extended nip for the passage therethrough of the web. An endless looped blanket extends through the extended nip such that the web is disposed between the blanket and the backing roll. The press means also includes means for selectively changing the pressure applied on the blanket along a machine direction relative to a further pressure applied for moving the press means relative to the backing roll such that optimum web properties are obtained and delamination of the pressed web is inhibited.

In a more specific embodiment of the present invention, the extended nip press apparatus includes an induction heater which is disposed closely adjacent to the backing roll for heating the backing roll thereby increasing the amount of water removed from the formed web during passage of the web through the extended nip.

Additionally, the present invention includes a heated extended nip press apparatus in which the press means also includes a press member defining a bore, the bore being connected to a source of hydraulic pressure. A piston sealingly and slidably cooperates with the bore such that when the bore is selectively connected to the source of hydraulic pressure, the piston moves relative to the backing roll. A shoe is connected to the piston so that the shoe slidably cooperates with the blanket.

In one embodiment of the present invention, the shoe is a hydrodynamic shoe which is pivotally connected to the piston.

More specifically, the hydrodynamic shoe defines a plurality of cross-machine directional recesses. The recesses selectively cooperate with the piston so that the shoe is permitted to pivot about the piston. The shoe is selectively positioned in a machine direction relative to the piston to optimize the web properties and to inhibit delamination of the pressed web.

More specifically, the press means also includes a rod which is rigidly secured to the piston and disposed between the piston and the shoe. The rod extends in a cross-machine direction such that the rod pivotally supports and is selectively disposed within one of the plurality of recesses.

In another embodiment of the present invention, the shoe is rigidly secured to the piston. The shoe defines a plurality of pockets disposed in a machine direction with each of the pockets being selectively connected to a source of hydraulic pressure such that the blanket is hydrostatically supported by the shoe and so that optimum web properties are obtained and delamination of the pressed web is inhibited.

In a further embodiment of the present invention, the hydrostatic shoe is pivotally secured relative to the piston about a cross-machine directional pivotal axis. The hydrostatic shoe defines a plurality of pockets which are spaced relative to each other in a machine direction. Each of the pockets are selectively connected to the source of hydraulic pressure for selectively applying different hydrostatic pressures on the blanket in a machine direction so that optimum web properties are obtained and delamination of the pressed web is inhibited.

In a heated extended nip press apparatus, a method for pressing water from a formed web, the method comprising the steps of moving the web contiguously with an endless looped blanket through an extended nip defined between a backing roll and a press means movable relative to the backing roll such that the web is disposed between the blanket and the backing roll; and selectively changing the pressures applied on the blanket along a machine direction relative to a further pressure applied for moving the press device relative to the backing roll such that optimum web properties are obtained and delamination of the pressed web is inhibited.

Many modifications and variations of the present invention will be readily apparent to those skilled in the art from a consideration of the detailed description contained hereinafter. However, such modifications and variations fall within the spirit and scope of the present invention as defined by the appended claims.

Included in such modifications would be the use of any type of heating means for heating the backing roll including gas fired heating, radiant heating, or the like.

Furthermore, variations of the present invention could include the provision of a porous surfaced backing roll such as disclosed in co-pending patent application Ser. No. 07/089,887 to Pulkowski et al, now U.S. Pat. No. 4,874,464, and U.S. Pat. No. 4,738,752. All of the disclosure of U.S. Pat. No. 4,738,752 and 4,874,469 are incorporated herein by reference.

BRIEF DESCRIPTION OF THE DRAWINGS

Similar reference characters refer to similar parts throughout the various embodiments of the present invention.

DETAILED DESCRIPTION OF THE DRAWINGS

Figure 1:
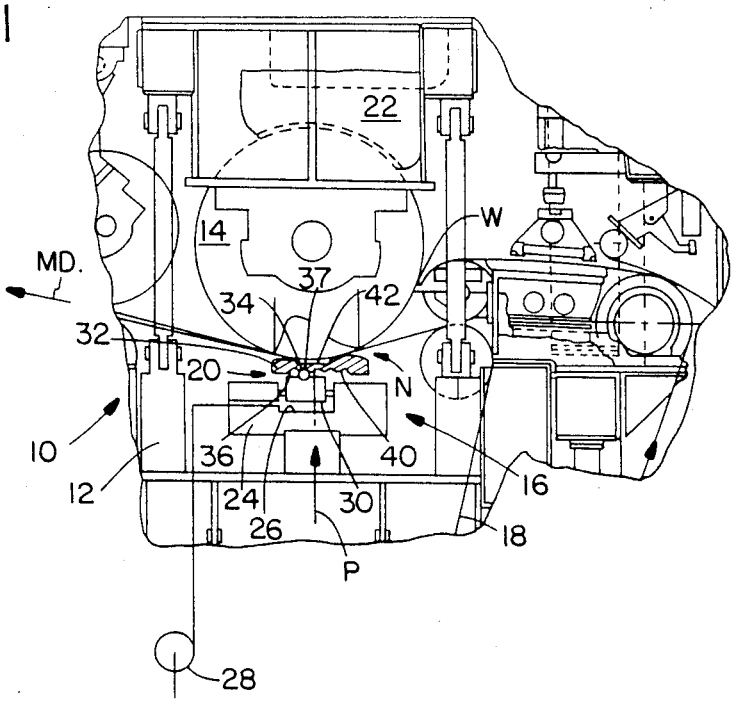
FIG. 1 is a fragmentary elevational view of a heated extended nip press apparatus according to the present invention.

FIG. 1 is a fragmentary side-elevational view of a heated extended nip press apparatus generally designated 10 for pressing water from a formed web W. The apparatus 10 includes a press frame 12 and a backing roll 14 rotatably supported by the press frame 12. A press means generally designated 16 is connected to the press frame 12 and movable relative to the backing roll 14. The press means 16 cooperates with the backing roll 14 for defining therebetween an extended nip N for the passage therethrough of the web W. The web W is carried into the nip N and through the nip N on felt F. An endless looped blanket 18 extends through the extended nip N such that the web W on the felt F is disposed between the blanket 18 and the backing roll 14. The web is pressed against the heated backing roll 14 and the felt F is pressed against the blanket 18. The press means 16 also includes means generally designated 20 for selectively changing the pressure applied on the blanket 18 along a machine direction as indicated by the arrow MD relative to a further pressure as indicated by the arrow P applied for moving the press means 16 relative to the backing roll 14 such that optimum web properties are obtained and delamination of the pressed web W is inhibited.

FIG. 1 also shows an induction heater 22 disposed closely adjacent to the backing roll 14 for heating the backing roll 14 thereby increasing the amount of water removed from the formed web W during passage of the web W through the extended nip N.

As shown in FIG. 1, the press means 16 also includes a press member 24 defining a bore 26. The bore 26 is connected to a source of hydraulic pressure 28. A piston 30 sealingly and slidably cooperates with the bore 26 such that when the bore 26 is selectively connected to the source of hydraulic pressure 28, the piston 30 moves relative to the backing roll 14.

As shown in FIG. 1, the heated extended nip press apparatus 10 includes a shoe 32 which is a hydrodynamic shoe pivotally connected at 34 to the piston 30.

Figure 2:
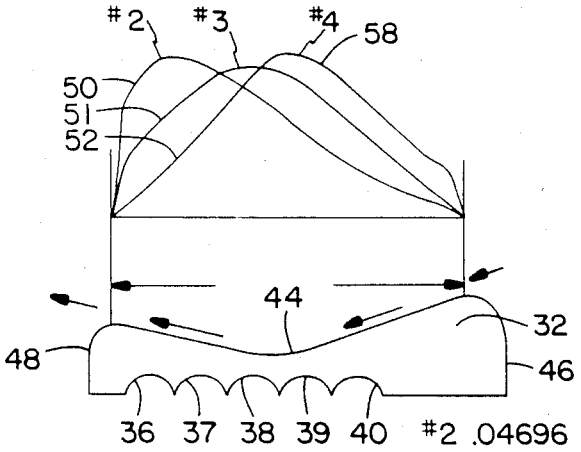
FIG. 2 is an enlarged side-elevational view of a hydrodynamic shoe according to the present invention together with a graph showing the pressure curves when the shoe is pivoted about the second, third and fourth recesses respectively.

As shown in FIG. 2, the shoe 32 defines a plurality of cross-machine directional recesses 36, 37, 38, 39 and 40. The recesses 36 to 40 selectively cooperate with the piston 30 so that the shoe 32 is permitted to pivot about the piston 30. The shoe 32 is selectively positioned in the machine direction MD relative to the piston 30 to optimize the web properties and to inhibit delamination of the pressed web W.

More specifically, as shown in FIG. 1, the press means 16 further includes a rod 42 rigidly secured to the piston 30 and disposed between the piston 30 and the shoe 32. The rod 42 extends in a cross-machine direction such that the rod 42 pivotally supports and is selectively disposed within one of the plurality of recesses 36 to 40. FIG. 1 shows the rod 42 disposed within the second recess 37.

FIG. 2 is an enlarged side-elevational view of the shoe 32 shown in FIG. 1 and shows the first, second, third, fourth and fifth recesses 36 to 40 respectively. The shoe 32 defines a concave surface 44 which cooperates with the backing roll 14 for defining therebetween the extended nip N. The shoe 32 also includes a leading and a trailing end 46 and 48 respectively. FIG. 2 shows the pressure curves, or pressure profiles, 50, 51 and 52 respectively when the rod 42 is disposed within the second, third and fourth recess 37, 38 and 39 respectively.

Accordingly, the position of the shoe 32 can be moved relative to the rod 42 in a machine direction MD so as to alter the pressure profile within the extended nip N. Generally, it has been found preferable to gradually decrease the pressure as shown in pressure profiles 52 with the rod 42 disposed within the fourth recess 39 so that the tendency for rapid flashing of steam is minimized thereby inhibiting delamination of the resultant web W.

Figure 3:
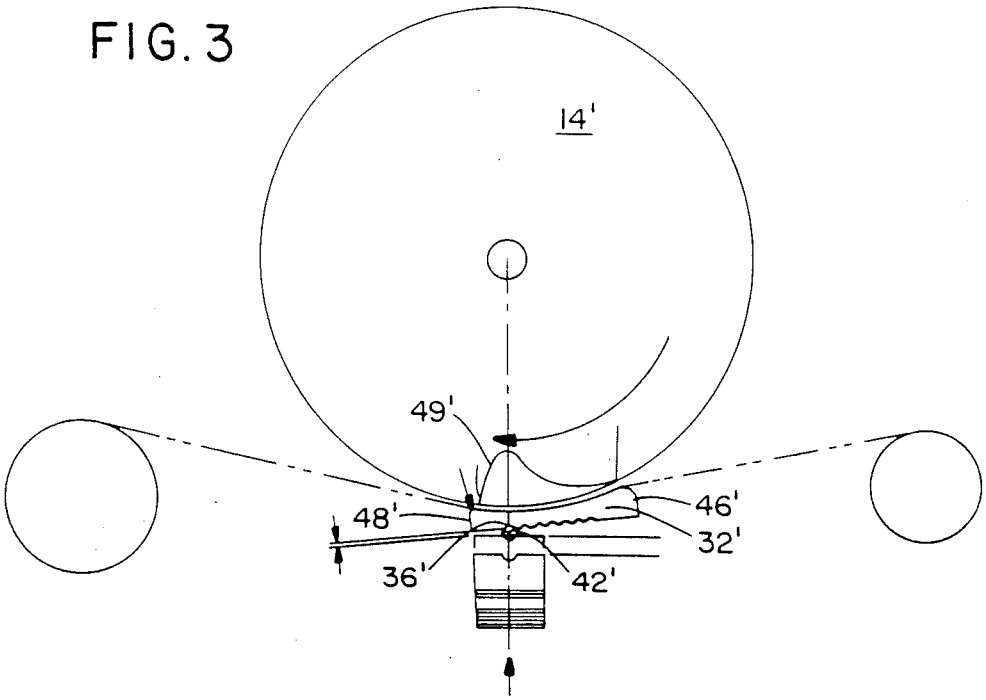
FIG. 3 is a side-elevational view similar to the arrangement shown in FIG. 1 but with a shoe having seven recesses and with the rod disposed in the first recess and showing the corresponding resultant pressure curve.

FIG. 3 is a side-elevational view of a similar arrangement to that shown in FIGS. 1–2 but showing a shoe having seven recesses. The rod 42 is disposed within the first recess 36' resulting in a pressure profile 49 in which the pressure rapidly decreases towards the trailing edge 48' of the shoe 32'.

Figure 4:
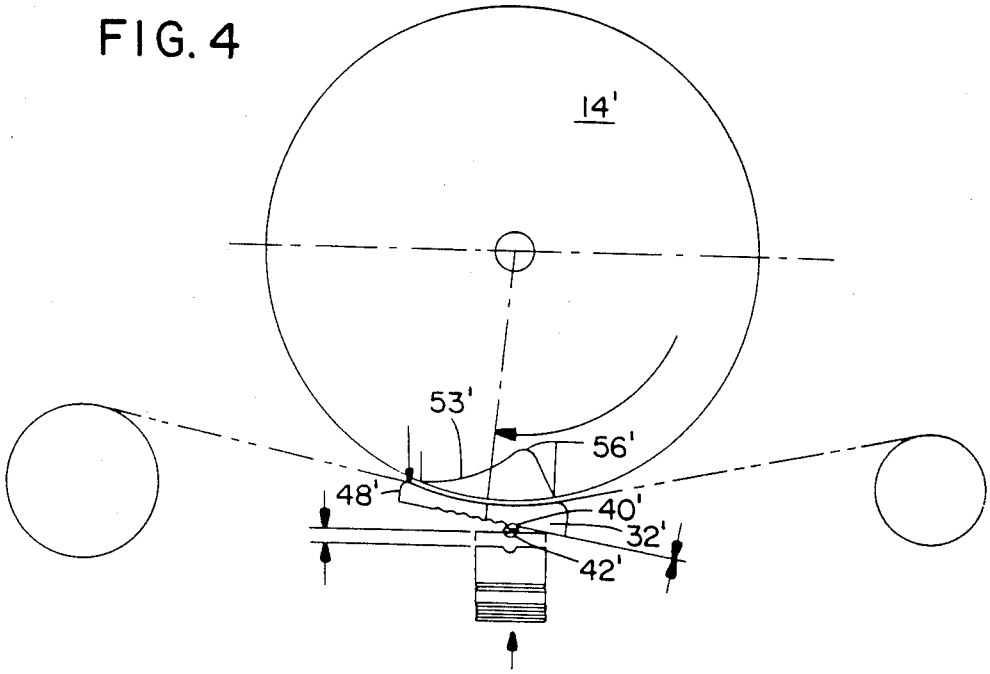
FIG. 4 is a similar view to that shown in FIG. 3 but shows the rod disposed in the seventh recess and the corresponding resultant pressure curve.

FIG. 4 is a similar view to that shown in FIG. 3 but shows the rod 42' disposed within the seventh recess 40' thereby resulting in a pressure profile 53' in which the pressure gradually decreases from a maximum value at the peak 56' of the profile 53' to a substantially zero pressure at the trailing edge 48' of the shoe 32'.

Figure 5:
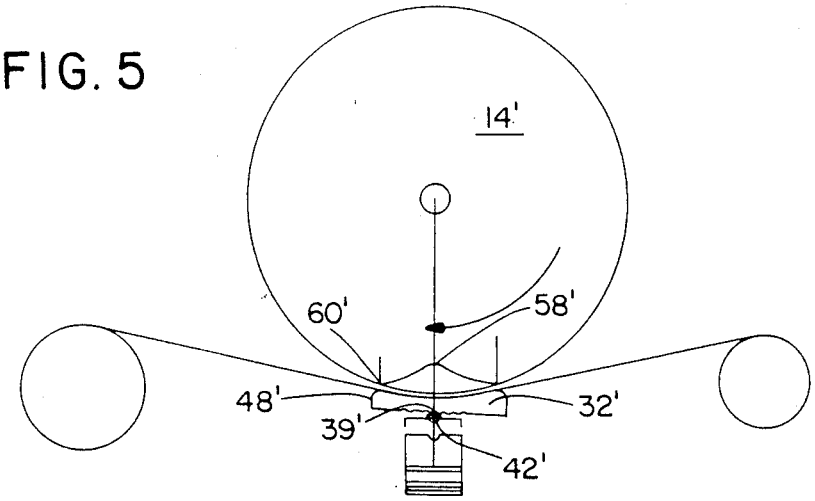
FIG. 5 is a similar view to that shown in FIG. 3 but shows the rod disposed in the fourth recess and the corresponding pressure curve.

FIG. 5 is a similar view to that shown in FIG. 3 but shows the rod 42' disposed within the fourth recess 39' resulting in a pressure profile 52' in which the pressure fairly gradually decreases from a maximum at the peak 58' to the exit point 60' adjacent to the trailing edge 48' of the shoe 32'.

Figure 6:
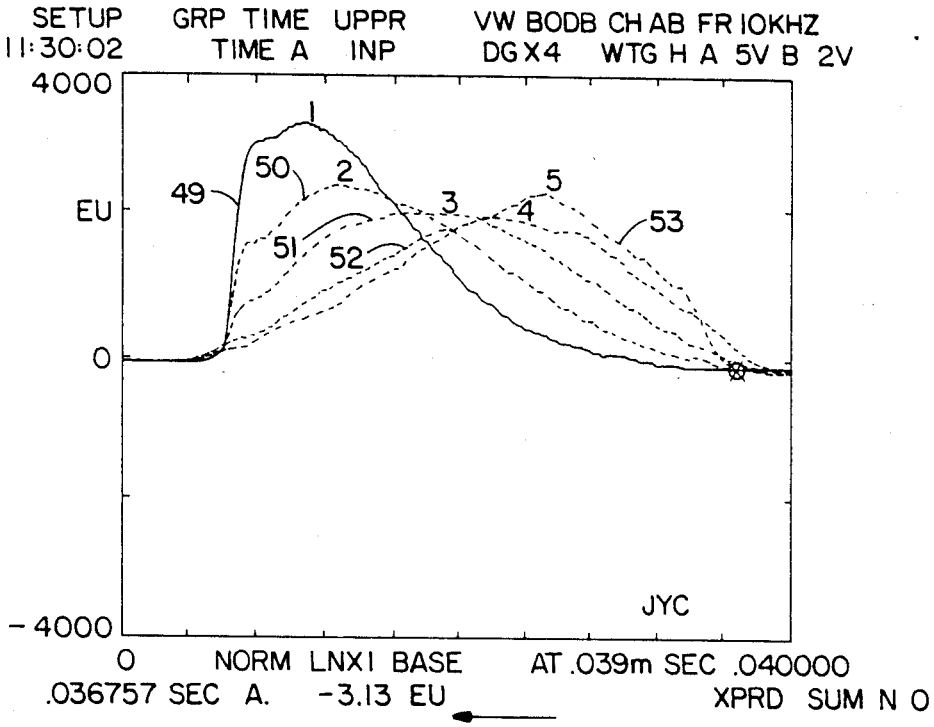
FIG. 6 is a graph showing the various pressure curves or pressure profiles resulting from pivoting the hydrodynamic shoe shown in FIG. 1 about the first to the fifth recess respectively.

FIG. 6 is a graph showing the pressure profiles 49, 50, 51, 52 and 53 resulting from the positioning of the rod 42 within the recesses 36 to 40 respectively.

Figure 7:
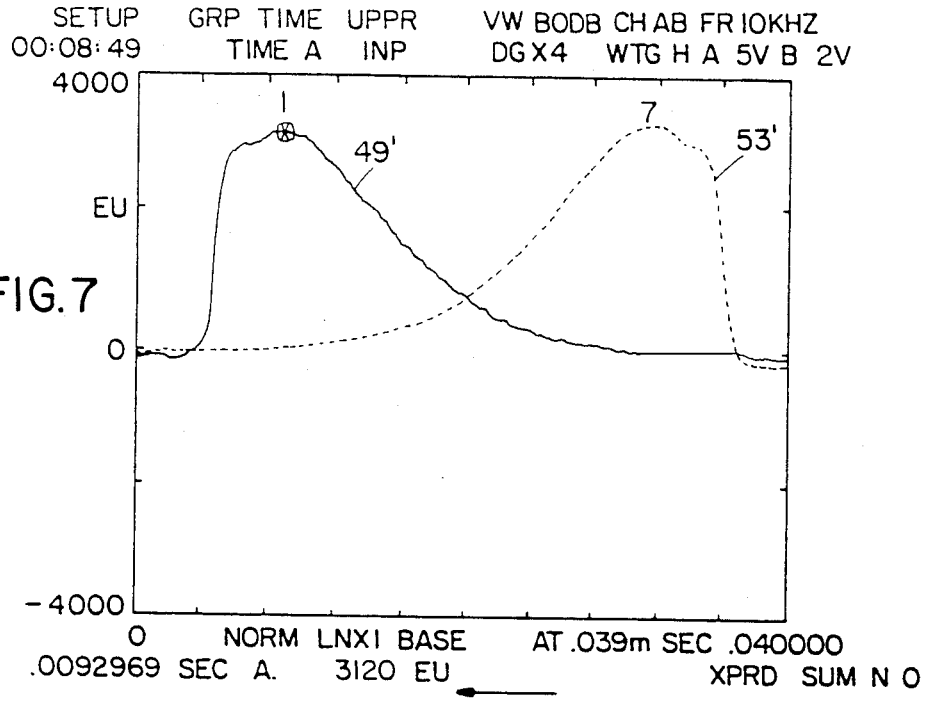
FIG. 7 is a graph showing the results of a test carried out using a hydrodynamic shoe shown in FIGS. 3–5 defining therein seven recesses, such graphs showing the pressure profiles obtained by pivoting the shoe about the first and seventh recess respectively.

FIG. 7 is another graph but showing the results obtained using the shoe defining seven recesses and shown in FIGS. 3–5 and shows the pressure profiles 49' and 53' resulting from the disposition of the rod 42' within the first and seventh recess respectively.

Figure 8:
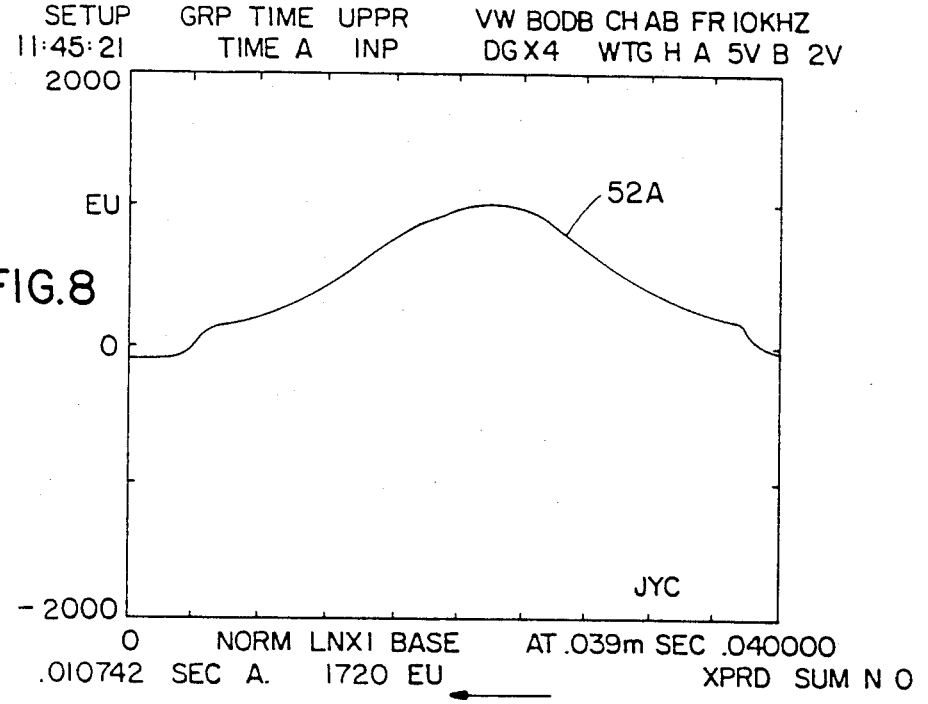
FIG. 8 is a graph showing the pressure profile for a hydrodynamic shoe pivoted about the fourth recess.

FIG. 8 is a graph showing the pressure profile resulting from the use of another shoe having a plurality of recesses defined therein, the pressure profile resulting from the rod 42 being positioned within a fourth recess.

Figure 9:
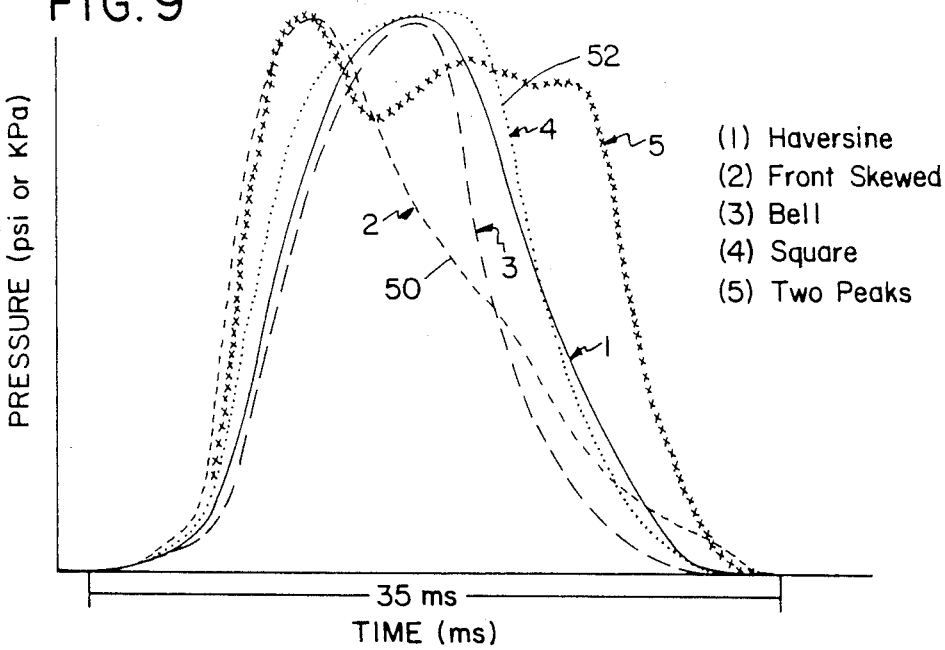
FIG. 9 is a graph showing various pressure profiles which indicate the results of tests to alleviate delamination and to enhance paper properties.

FIG. 9 is a graph showing the various pressure profiles tested in an effort to alleviate delamination and enhance paper properties. Certain profiles are achievable with hydrodynamic shoes, others with hydrostatic shoes. Pressure profile 50 is achieve with a hydrodynamic shoe, 32 with the rod 42 disposed within recess 37. The choice of the pressure profile is dependent on web sensitivity to delamination and upon the properties desired.

Figure 10:
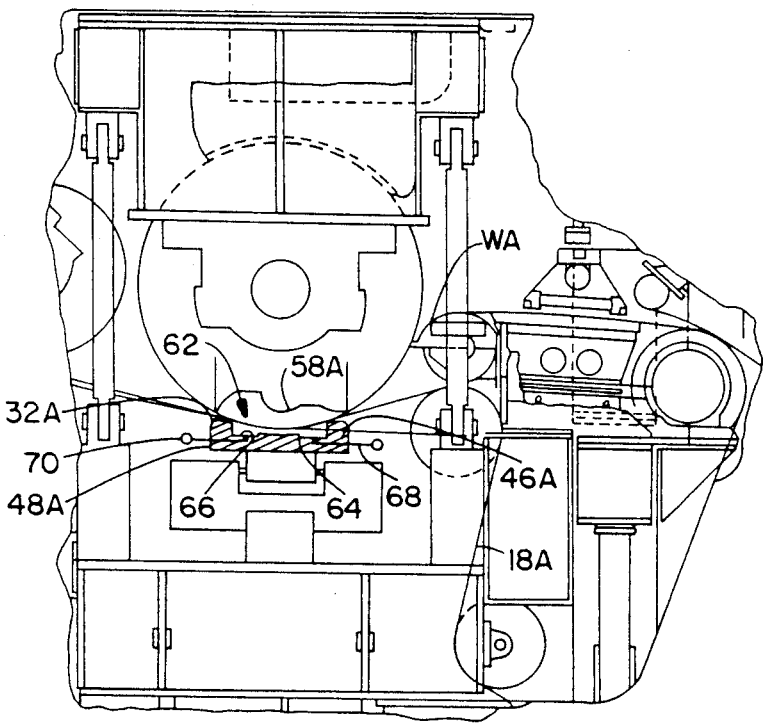
FIG. 10 is a fragmentary side-elevational view of a further embodiment of the present invention in which the shoe is a hydrostatic shoe defining a plurality of pockets therein disposed in a machine direction.

FIG. 10 is a fragmentary side-elevational view of an alternative embodiment of the present invention in which a shoe 32A is a hydrostatic shoe defining a plurality of pockets generally designated 62. More specifically, a first pocket 64 is disposed adjacent to the leading edge 46A of the shoe 32A and a second pocket 66 is disposed adjacent to the trailing edge 48A of the shoe 32A. The hydraulic pressure applied to the pockets 64 and 66 via hydraulic lines 68 and 70 respectively are selectively controlled in order to obtain an optimum pressure profile 58A as shown in FIG. 10.

Figure 11:
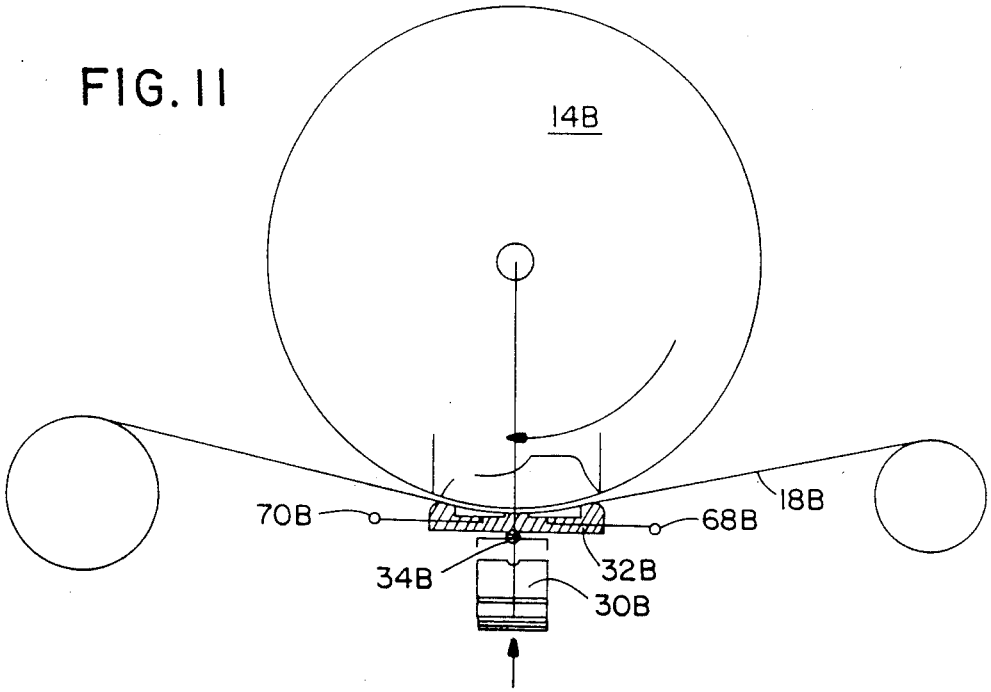
FIG. 11 is a side-elevational view of a further embodiment of the present invention in which a hydrostatic shoe is pivotally secured relative to a piston and shows the pressure profile obtained thereby.

FIG. 11 is a side-elevational view of a further embodiment of the present invention in which a hydrostatic shoe 32B is pivotally secured at 34B to a piston 30B.

Figure 12:
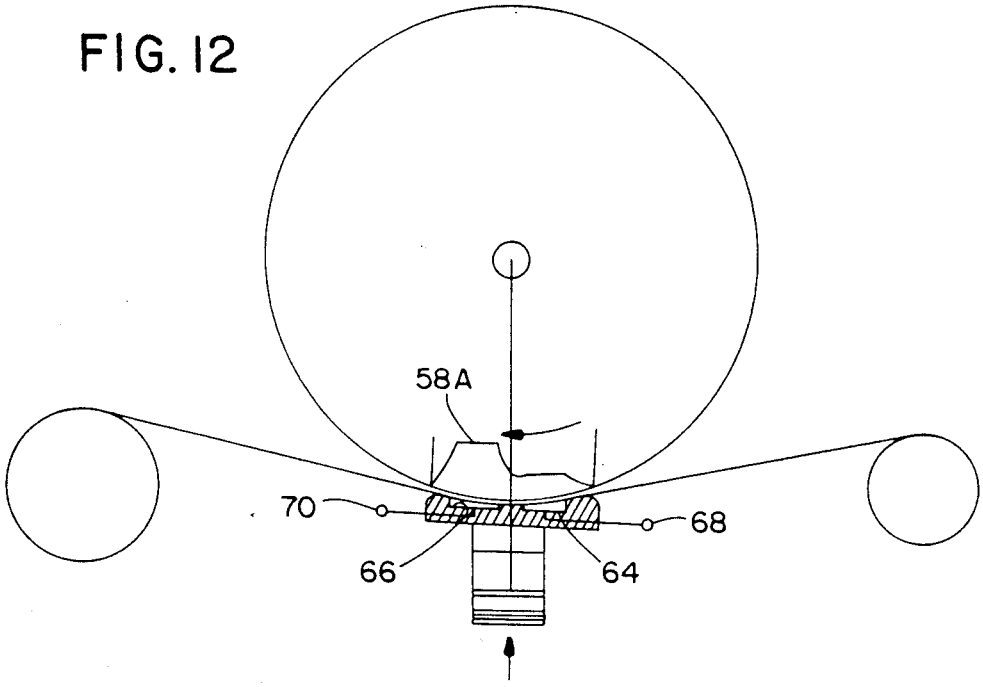
FIG. 12 is an enlarged view of the arrangement shown in FIG. 10 but shows an increased pressure being applied towards the trailing edge of the shoe.

FIG. 12 is an enlarged view of the embodiment shown in FIG. 10 showing the pressure profile 58A which may be changed by varying the pressure differential within the first and second pockets 64 and 66 respectively.

In operation of the apparatus shown in FIGS. 1 to 9 using a hydrodynamic shoe, the hydraulic pressure within the bore 26 is disconnected so that the piston 30 and the shoe 32 supported thereon is lowered away from the backing roll 14. The shoe is then moved in the machine direction MD so that the rod 42 engages a different recess so that the optimum pressure profile for a particular furnish can be obtained.

In operation of the apparatus shown in FIGS. 10 to 12, the difference in pressure within the pockets 64 and 66 can be controlled and varied in order to optimize web properties and to inhibit delamination without lowering the shoe relative to the backing roll.

In the practice of the present invention, it is very important that the entrance and exit tail of the pressure profile shape be smooth in order to avoid delamination. Furthermore, it is important to note that the hydrostatic pressure pockets may be individually controlled in both a machine direction and a cross-machine direction locations.

During high temperature pressing, the exiting dryness, density and strength properties of the sheet being pressed were found to be influenced by the temperature, time in the nip, and pressure. These properties can be tailored by various combinations of pressure profile shape. In most cases, the sheet properties can be improved by proper combinations of all the aforementioned variables. Temperature and nip residence time have been found to be the most influential in building sheet properties. Furthermore, tests have indicated that the pressure profile shape can also be used to build sheet properties. Exiting dryness in particular can be improved. Strength and bulk also appear to be influenced. For example, the pressure profile shape 54 may produce a higher strength sheet with the same bulk as that with profile shape 52 shown in FIG. 6. The position number 7 shown as profile 53' in FIG. 7 may densify the sheet more than profile number 52 shown in FIG. 6 or 52A of FIG. 8 with subsequent improvement in strength.

The present invention provides a relatively inexpensive means for altering the machine direction pressure profile within a heated extended nip press thereby optimizing web properties and avoiding any tendency of the web to delaminate.

What is claimed is:

1. A heated extended nip press apparatus for pressing water from a formed web, said apparatus comprising:

a press frame;

a backing roll rotatably supported by said press frame;

heating means disposed closely adjacent to said backing roll for heating said backing roll;

a press means connected to said press frame and movable relative to said backing roll, said press means cooperating with said backing roll for defining therebetween an extended nip for the passage therethrough of the web;

an endless looped blanket extending through said extended nip such that the web is disposed between said blanket and said backing roll;

said press means including:

means for applying a pressure for moving said press means relative to said backing roll;

further means for selectively changing pressures applied on said blanket along a machine direction;

a press member defining a bore, said bore being connected to a source of hydraulic pressure;

a piston sealingly and slidably cooperating with said bore such that when said bore is selectively connected to said source of hydraulic pressure, said piston moves relative to said backing roll;

a shoe connected to said piston such that said shoe slidably cooperates with said blanket;

said show being a hydrodynamic shoe which is pivotally connected to said piston; and said show defining a plurality of cross-machine direction recesses, said recesses selectively cooperating with said piston so that said shoe is permitted to pivot about said piston and so that said shoe is structured and arranged to be selectively positioned in a machine direction relative to said piston by means of said recesses to optimize said web properties and to inhibit delamination of the pressed web.

2. A heated extended nip press apparatus as set forth in claim 1 wherein said press means further includes:

a rod rigidly secured to said piston and disposed between said piston and said shoe, said rod extending in a cross-machine direction such that said rod pivotally supports and is selectively disposed within one of said plurality of recesses.

3. A heated extended nip press apparatus as set forth in claim 1 wherein said heating means comprises:

an induction heater disposed closely adjacent to said backing roll for heating said backing roll thereby increasing the amount of water removed from the formed web during passage of the web through said extended nip.

* * * * *

UNITED STATES PATENT AND TRADEMARK OFFICE

CERTIFICATE OF CORRECTION

PATENT NO. : 4,973,384

DATED : 11/27/90

INVENTOR(S) : Jere Crouse et al

It is certified that error appears in the above—identified patent and that said Letters Patent is hereby corrected as shown below:

Column 8, line 23: "show" should read --shoe--.

Column 8, line 25: "show" should read --shoe--.

Signed and Sealed this

Seventeenth Day of November, 1992

*Attest:*

DOUGLAS B. COMER

*Attesting Officer*

*Acting Commissioner of Patents and Trademarks*